US009226627B2

(12) United States Patent
Powling et al.

(10) Patent No.: US 9,226,627 B2
(45) Date of Patent: Jan. 5, 2016

(54) WET WIPES CONTAINER WITH FLEXIBLE DISPENSING ORIFICE

(71) Applicant: Kimberly-Clark Worldwide, Inc., Neenah, WI (US)

(72) Inventors: David James Sealy Powling, Combined Locks, WI (US); Robert Michael Hill, Neenah, WI (US); Robert Samuel Schlaupitz, New London, WI (US); Andrew John Fojtik, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 51 days.

(21) Appl. No.: 14/230,991

(22) Filed: Mar. 31, 2014

(65) Prior Publication Data

US 2015/0272405 A1 Oct. 1, 2015

(51) Int. Cl.
*A47K 10/42* (2006.01)
*A47K 10/32* (2006.01)

(52) U.S. Cl.
CPC ..... *A47K 10/421* (2013.01); *A47K 2010/3266* (2013.01)

(58) Field of Classification Search
CPC ..... A47K 10/421
See application file for complete search history.

(56) References Cited

U.S. PATENT DOCUMENTS 3,369,699 A 2/1968 Enloe et al.
3,780,908 A 12/1973 Fitzpatrick et al.
4,865,221 A 9/1989 Jackson et al.
5,540,332 A 7/1996 Kopacz et al.
6,196,390 B1 3/2001 Bando
6,523,690 B1 2/2003 Buck et al.
6,550,634 B1 4/2003 De Miquel et al.
6,683,143 B1 1/2004 Mumick et al.
6,766,919 B2 7/2004 Huang et al.
6,840,401 B2 1/2005 Amundson
7,063,245 B2 6/2006 Faulks et al.
7,070,143 B2 7/2006 Faulks et al.
7,073,684 B2 7/2006 Decker et al.
7,081,080 B2 7/2006 Sosalla et al.
7,303,092 B2 12/2007 Sarbo et al.
7,681,756 B2 3/2010 Baer et al.
7,699,166 B2 4/2010 Gauger et al.
8,030,226 B2 10/2011 Bradley et al.

(Continued)

FOREIGN PATENT DOCUMENTS

EP 0 857 453 B1 5/2002

OTHER PUBLICATIONS

Co-pending U.S. Appl. No. 13/863,107, filed Apr. 15, 2013, by Fulscher et al. for "Wipes Dispenser."

(Continued)

*Primary Examiner* — Leslie A Nicholson, III
*Assistant Examiner* — Ayodeji Ojofeitimi
(74) *Attorney, Agent, or Firm* — Kimberly-Clark Worldwide, Inc.

(57) ABSTRACT

A dispensing container for wet wipes includes a pop-up style dispensing means formed by a rigid port which surrounds a flexible, rubber-like material or sheet having one or more slits through which the wet wipes are dispensed. The configuration of the slits, in combination with the flexibility of the rubber-like material, enables the user to insert at least one finger through the slit to thread a wipe through the slit. The dispensing means has a Penetration Index of greater than 600 grams.

15 Claims, 8 Drawing Sheets

(56) References Cited

U.S. PATENT DOCUMENTS

| | | | |
|---|---|---|---|
| 2008/0135572 | A1 | 6/2008 | Brennan et al. |
| 2012/0048858 | A1 | 3/2012 | Peters et al. |
| 2013/0037432 | A1 | 2/2013 | Chang et al. |

OTHER PUBLICATIONS

American Society for Testing Materials (ASTM) Designation: D 395-03 (reapproved 2008), "Standard Test Methods for Rubber Property—Compression Set," pp. 1-6, published Jun. 2008.

American Society for Testing Materials (ASTM) Designation: D 412-98a, "Standard Test Methods for Vulcanized Rubber and Thermoplastic Elastomers—Tension," pp. 43-55, published Aug. 1998.

American Society for Testing Materials (ASTM) Designation: D 790-10, "Standard Test Methods for Flexural Properties of Unreinforced and Reinforced Plastics and Electrical Insulating Materials", Apr. 2010, pp. 1-11.

American Society for Testing Materials (ASTM) Designation: D 792-00, "Standard Test Methods for Density and Specific Gravity (Relative Density) of Plastics by Displacement," Published Mar. 2001, pp. 1-6.

American Society for Testing Materials (ASTM) Designation: D2240-05, "Standard Test Method for Rubber Property—Durometer Hardness," pp. 1-13, published Sep. 2005.

American Society for Testing Materials (ASTM) Designation: D6125-97, "Standard Test Method for Bending Resistance of Paper and Paperboard (Gurley Type Tester)," pp. 885-889, published Feb. 1998.

WET WIPES CONTAINER WITH FLEXIBLE DISPENSING ORIFICE

BACKGROUND OF THE INVENTION

A wide variety of wet wipes dispensing containers are available in the market today. These containers may be broadly categorized into two classes: reach-in and pop-up. Within the pop-up category, some containers provide a stack of flat wipes, which are interfolded, and which are most commonly dispensed from a tub. Other containers provide a continuous roll of wipes material, intermittently perforated along lines transverse to the direction of the roll to define a series of wipes integrally interconnected at their edges, and which are dispensed from an upright cylindrical container. The pop-up style containers have gained popularity because the wet wipe is more readily available to the user. Although there is a greater opportunity for the wipes in a pop-up style container to at least partially dry out, improvements in container design have mitigated this problem.

However, with pop-up style dispensing containers, there are occasions where the pop-up feature fails and the user needs to reach into the container to retrieve the next wipe. Unfortunately, current pop-up containers do not have openings that (1) are tight enough to help minimize instances in which a succeeding wipe is inadvertently dispensed with the leading wipe; (2) are loose enough to optimally allow the succeeding wipe to at least partially pass through the opening before the leading wipe ends contact with the succeeding wipe; (3) are tight enough to help hold the succeeding wipe in a "pop-up" position rather than falling back into the container; (4) enable a user to comfortably reach through the opening, such as reaching into the container if the succeeding wipe fails to "pop-up" and instead falls back into the container; and (5) are small enough to allow minimal air circulation into the wipe container to prevent substantial dry out of the wipes within the container.

U.S. Pat. No. 6,523,690 to Buck et al. discloses a wet wipe container with a flexible orifice to address some of these issues. However, the dispensing means taught by Buck are limited to those having a Penetration Index (see below) of 600 grams or less. It was thought at that time that a Penetration Index above 600 grams was sub-optimal in terms of maximizing the ability to help achieve the five objectives listed above. However, it has been discovered that in certain circumstances, due to advances in the composition and dispensing of wet wipes, that a Penetration Index of 600 grams or less is not always desirable.

SUMMARY OF THE INVENTION

It has now been discovered that certain pop-up style wet wipe containers can simultaneously provide effective pop-up and reach-in capability. This is not only useful for retrieving wipes that fail to dispense, but it also enables users to push the popped-up wipe back into the container if they wish to improve moisture retention or to more readily maintain sanitary conditions, and thereafter easily retrieve the wipe.

Hence in one aspect, the invention resides in a wet wipe dispensing container containing interfolded or integrally interconnected wet wipes and having a pop-up style dispensing means positioned beneath a retractable lid. The dispensing means include a rigid port that surrounds a flexible, rubber-like material or sheet. The material has one or more slits through which individual wet wipes are removed from the container when the lid is open. The flexibility of the sheet and the length of the slit(s) in combination are sufficient to enable a user to insert at least one finger through the slit to thread a wipe through the slit. The dispensing means has a Penetration Index of greater than 600 grams.

For purposes herein, the "container" can be any container suitable for storing and dispensing wet wipes including but not limited to tubs, canisters, pouches, purses, soft packs, and the like.

The configuration and the length of the slit(s) in the flexible, rubber-like material or sheet can vary giving consideration to a number of factors, including evaporation losses, ease of wipe removal, sufficient frictional engagement to maintain the pop-up feature, and access to the wipes within the container in the event the pop-up feature fails. In particular embodiments, it has been found that multiple intersecting slits work well to meet all of the foregoing considerations. In other embodiments a single slit, such as a slit with a wavy shape, has been found to be most effective. This will be described in more detail with reference to the Drawings.

The nature of the flexible, rubber-like material or sheet having the slits must be sufficiently stiff and have sufficient memory so as to maintain a reasonable impediment to evaporation losses and to hold the wet wipes in the pop-up position. At the same time, it must be pliable enough and somewhat elastic to enable a user to insert at least one finger therethrough into the container, such as, for example, (1) sufficiently far to contact or grasp a wipe from the top of the stack, even when the top of the stack is well below the resting position of the rubber-like material; or (2) to thread a wipe through the slit or slits from the inside of the container, when the main lid is open to provide access to the underside of the dispensing means or partition. To meet these requirements, the properties of the flexible, rubber-like sheet combine with the selected slit configuration to attain the desired end result. It will be appreciated that as the length of the slits increases, it becomes easier to reach one's finger or fingers through the slit or slits because the opening is larger. The same is true as the stiffness decreases. Although the rubber-like material can take many forms, a sheet form is suitable because it is readily made for commercial purposes.

In an effort to quantify the properties of the rubber-like material or sheet, the relevant properties can be described in terms of the hardness, stiffness, thickness, elasticity, and any combination thereof.

More specifically, the Shore A hardness (as measured by ASTM D2240) of the flexible, rubber-like sheet or material can be about 100 or less, more specifically from about 20 to about 70, and still more specifically from about 30 to about 60.

The Gurley stiffness of the flexible, rubber-like sheet or material (as measured by ASTM D 6125-97 "Standard Test Method for Bending Resistance of Paper and Paperboard") can be about 10,000 milligrams of force (mgf) or less, more specifically from about 100 to about 8000 mgf, more specifically from about 200 to about 6500 mgf, and still more specifically from about 300 to about 1500 mgf.

The thickness of the flexible, rubber-like sheet can be about 0.1 millimeter or greater, more specifically from about 0.1 to about 2 millimeters, and still more specifically from about 0.8 to about 1.5 millimeters.

The elasticity of the flexible rubber-like material or sheet, as characterized by the tensile stress at 100 percent elongation and measured in accordance with ASTM D412 "Standard Test Methods for Vulcanized Rubber and Thermoplastic Elastomers", can be about 10 megapascals (Mpa) or less, more specifically from about 0.1 to about 7 Mpa, and still more specifically from about 0.5 to about 2.5 Mpa.

Examples of flexible rubber-like materials used in particular embodiments of the container of the present disclosure include thermoplastic elastomeric (TPE) materials that can be used to provide acceptable dispensing. Materials which can be employed include (but are not limited to): any of the family of styrenic-based TPE's (i.e. styrenic block copolymer compounds); styrenic-based TPE's containing rubber modifiers such as Kraton™, Santoprene™, or other rubber modifiers; specialty copolymers, such as ethylene-methyl acrylate copolymers (e.g. EMAC™ of the Eastman Chemical Company); thermoset rubbers; polyurethane; alloys; amides; engineering TPE's; olefinic-based; olefinic vulcanizates; polyester-based; polyurethane-based. One such material for the flexible, rubber-like sheet could be that manufactured by the GLS Corporation of McHenry, Ill., USA and known as resin #G2701. The G2701 material is one of the resins in the product family of TPEs. G2701 is a styrenic-based material and is in the family of Styrenic block copolymer compounds. Some particular properties of the G2701 can be: specific gravity of 0.90 g/cc (per ASTM D792); hardness (Shore A durometer) of 68 (ASTM D2240); and compression set of 24% at room temperature, 96% at 70° C. (per ASTM 395B). Another similar material is known as G2755 and also sold by GLS Corporation. In addition, a lubricant (e.g., wax) can be added to lower the coefficient of friction of the continuous slit which can benefit injection molding, wet wipes dispensing, and physical handling of the flexible orifice. The G2701 TPE resin with 0.25% wax additive sold by GLS Corporation and known as #LC217-189 can be used.

Alternatively, the performance of the dispensing means can be measured more directly by using a tensile testing machine to insert a ball-shaped probe into the dispensing opening under controlled conditions and measuring the force required to overcome the resistance of the opening. This simulates the use of one's finger to reach into the container, such as to retrieve a wipe. In general, the measurement involves placing a container to be tested underneath a specially-designed probe which is mounted to a tensile tester. The tensile tester lowers the probe into the center of the container dispensing means at a predetermined speed and measures the peak load, in grams, required to penetrate the opening. This test, as more specifically described below, results in a value referred to herein as the "Penetration Index". The containers of this invention can have a Penetration Index of greater than 600 grams, more particularly greater than 1000 grams, still more particularly greater than 2000, yet more particularly greater than 3000 grams, and still more particularly greater than 3500 grams. In one embodiment, the Penetration Index is less than 6000 grams, and more particularly less than 5000 grams.

The tensile tester is a MTS Sintech 1/G with a MTS 10 pound load cell. The software is TestWorks for Windows 3.10. The load cell contains a 0.5 inch grip adapter for receiving the metal ball probe. The ball probe used is approximately 4.5 inches long. The bottom portion of the probe, which contacts the sample to be tested, is ball-shaped and has a ball diameter of 0.75 inch. The middle portion of the probe consists of a connecting "neck" which is approximately 0.375 inches in diameter and 1.375 inches long. The upper section of the probe is approximately 0.5 inch in diameter and 2.4 inches long. The end of the upper section contains a flat area to allow the probe to fit into the grip adapter of the tensile tester. The flat area is 0.125 inch off the center of the probe.

When conducting the test, the container to be tested is securely placed on a suitable surface such that the center of the dispensing opening is placed directly underneath the ball probe. The probe is initially positioned such that it is approximately one inch above the dispensing opening. Upon the start of the test, the probe moves downward at a rate of 80 inches per minute for a distance of 2 inches. The probe is held for one second at this bottom position and then is moved upward to its initial position at the same rate. The test is repeated two additional times. The peak load readings from the tensile tester, expressed as grams of force, are averaged, and the result is the Penetration Index for the sample.

As used herein, the term "rigid" is used to mean a level of stiffness commonly associated with materials used to manufacture wet wipes tubs. Numerically, these materials typically have a flexural modulus (as measured in accordance with ASTM D790 "Standard Test Method for Flexural Properties of Unreinforced and Reinforced Plastics and Electrical Insulating Materials") of about 500 Newtons per square millimeter or greater, more specifically from about 1100 to about 1550 Newtons per square millimeter.

The term "interfolded wipes" as used herein means a plurality of wipes, such as a stack of wipes, in which separate individual wipes are releasably attached to each other by folding an edge of one wipe over the edge of an adjacent wipe.

The term "integrally interconnected wet wipes" as used herein means a plurality of wipes, such as in a stack or roll, in which individual wipes are defined by a series of perforation lines that extend across a continuous web, ribbon, or sausage of wipes, such that each wipe can be detached from the remaining wipes by tearing the sheet along the perforation lines.

Both interfolded wet wipes and integrally interconnected wet wipes can be used in conjunction with the principles of this invention.

DETAILED DESCRIPTION OF THE DRAWINGS

Figure 1:
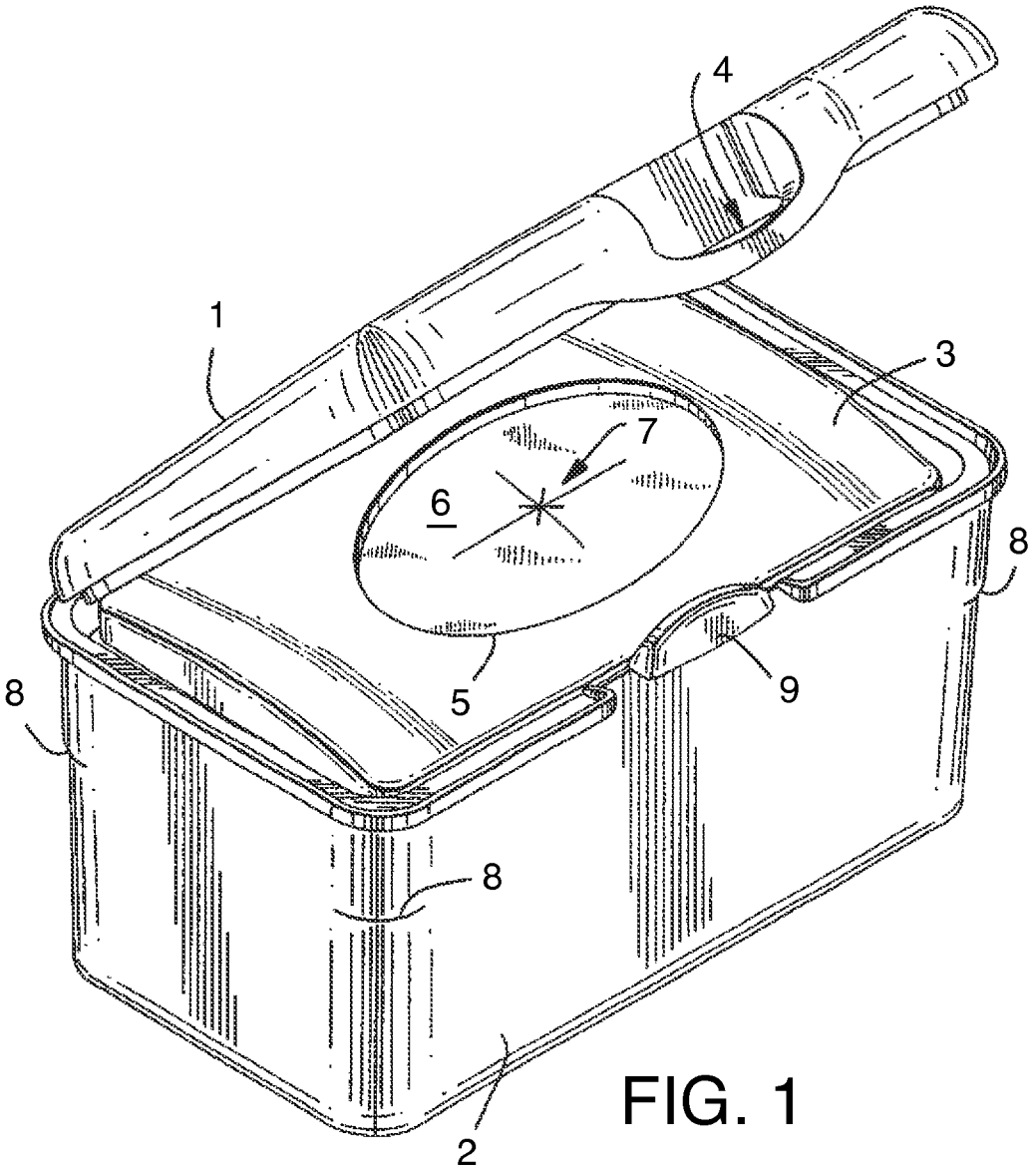
FIG. 1 is a perspective view of one embodiment of a wet wipe container embodying principles of this invention with the lid open, illustrating the placement of the dispensing means within a removable inner cover.

Referring to FIG. 1, the invention will be described in greater detail. Shown is a rigid plastic wet wipe container having a lid 1 hingedly attached to a base 2 and a removable inner cover 3. The removable inner cover contains a pop-up style dispensing means comprising a rigid port 5 which surrounds a flexible, rubber-like material or sheet 6 having several slits 7 through which individual wet wipes are removed from the container. The removable inner cover shown is somewhat dome-shaped with a slight pitch toward the front of the container. It is removably secured to the sidewalls of the base by a small lip around the periphery of the inner cover that engages with notches within several protruding ribs on the inner surface of the sidewalls (not shown). It also rests on a small support surface in each of the four corners of the base, which is outwardly visible by discontinuities 8 in the rounded corners of the base. The lid is secured in a closed position by a suitable latching mechanism, in which a protrusion 9 in the front lip of the base is engaged by an opening 4 in the front lip of the lid.

The shape of the rigid port in the embodiment shown in FIG. 1 is oval, but can be any shape and size large enough to in particular embodiments enable the user to reach into the container with their finger or fingers to contact or grasp the next available wet wipe in the event of a dispensing failure. Other suitable shapes include, without limitation, square, rectangular, circular, triangular and irregular. The area of the oval illustrated in the container of FIG. 1 is about 6 square inches.

The slits in the flexible, rubber-like sheet as shown are star-shaped. The longest slit is about 1.75 inches and the smaller slits are about 0.25 inch. However, many other slit configurations are also suitable including, without limitation, X-shaped slits, straight slits and curvilinear slits. The length of the individual slits can be about 0.25 inch to about 3 inches, more specifically from about 0.25 inch to about 2 inches. The length of the slits will in part depend upon the slit configuration and the number of slits. The sum total length for all of the slits in the sheet or material can be about 2.5 inches or greater. In particular embodiments, it is preferred to have at least one slit with a length of about 1 inch which, in combination with the elasticity of the rubber-like sheet or material, will allow the user to reach into the container with at least two fingers as necessary. For very tall containers, it may be necessary to lengthen at least one of the slits so that the user can still reach the bottom of the container. For such a container, at least one of the slits may need to be between 2 and 6 inches in length, more specifically between 3 and 4 inches in length. This will allow the user to insert one or more fingers as well as part of the hand into the container to retrieve a wipe. In other tall containers, such as those in which a stack of wipes stands at least partially on its side, a shorter slit is suitable, such as short as 0.5 inches.

Figure 2:
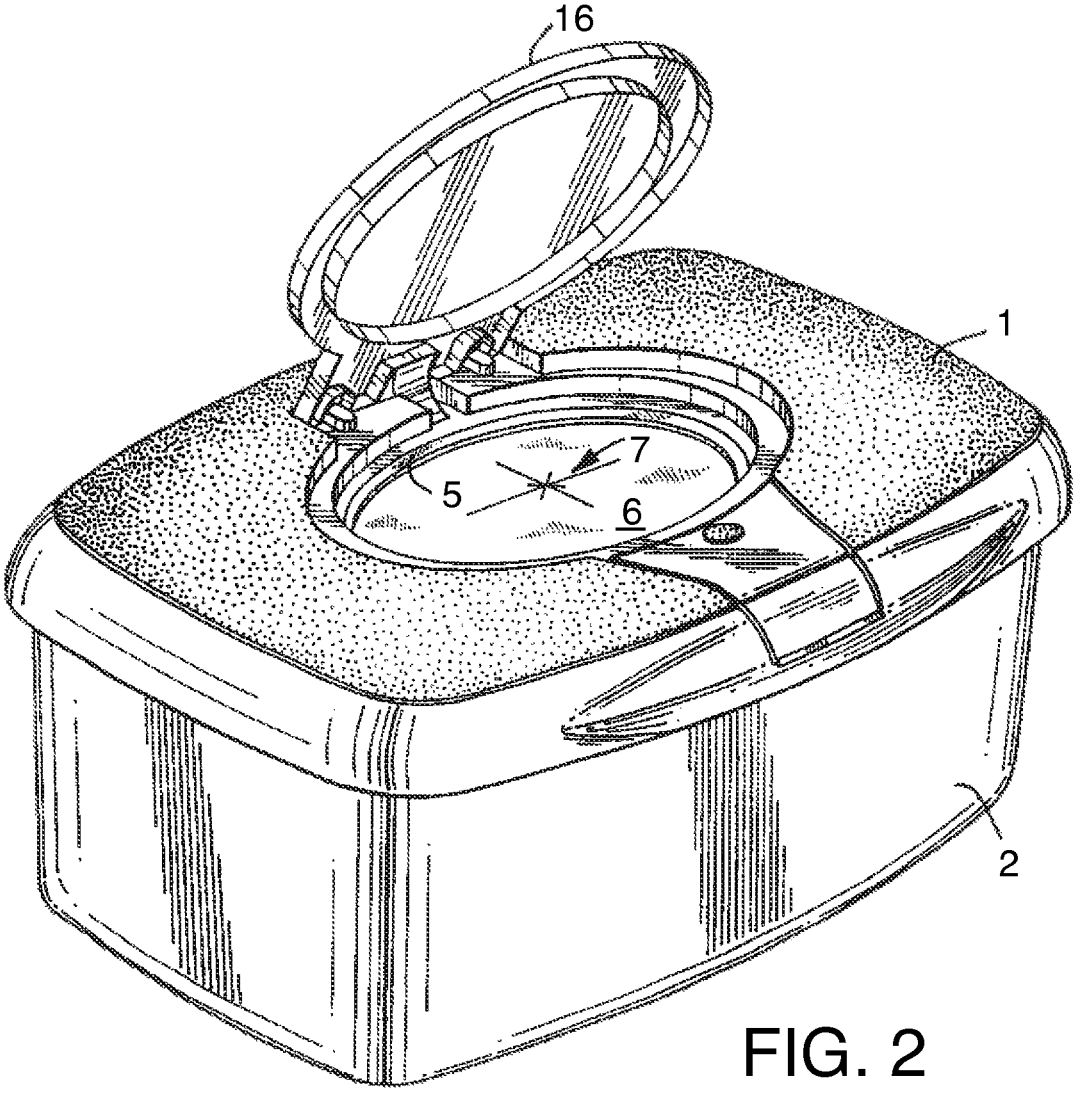
FIG. 2 is a perspective view of another embodiment of a wet wipe container embodying principles of this invention with the lid open, wherein the dispensing means is recessed within the rigid top of the container.

FIG. 2 is a perspective view of another rigid plastic container in accordance with this invention, in which the pop-up style dispensing means is recessed within the lid of the container. Shown is a removable lid 1, a base 2, a rigid port 5 which surrounds a flexible, rubber-like sheet 6 having several slits 7 through which the wet wipes are dispensed. This container also has a pop-up lid 16 which can be closed to seal the container when not in use.

Figure 3:
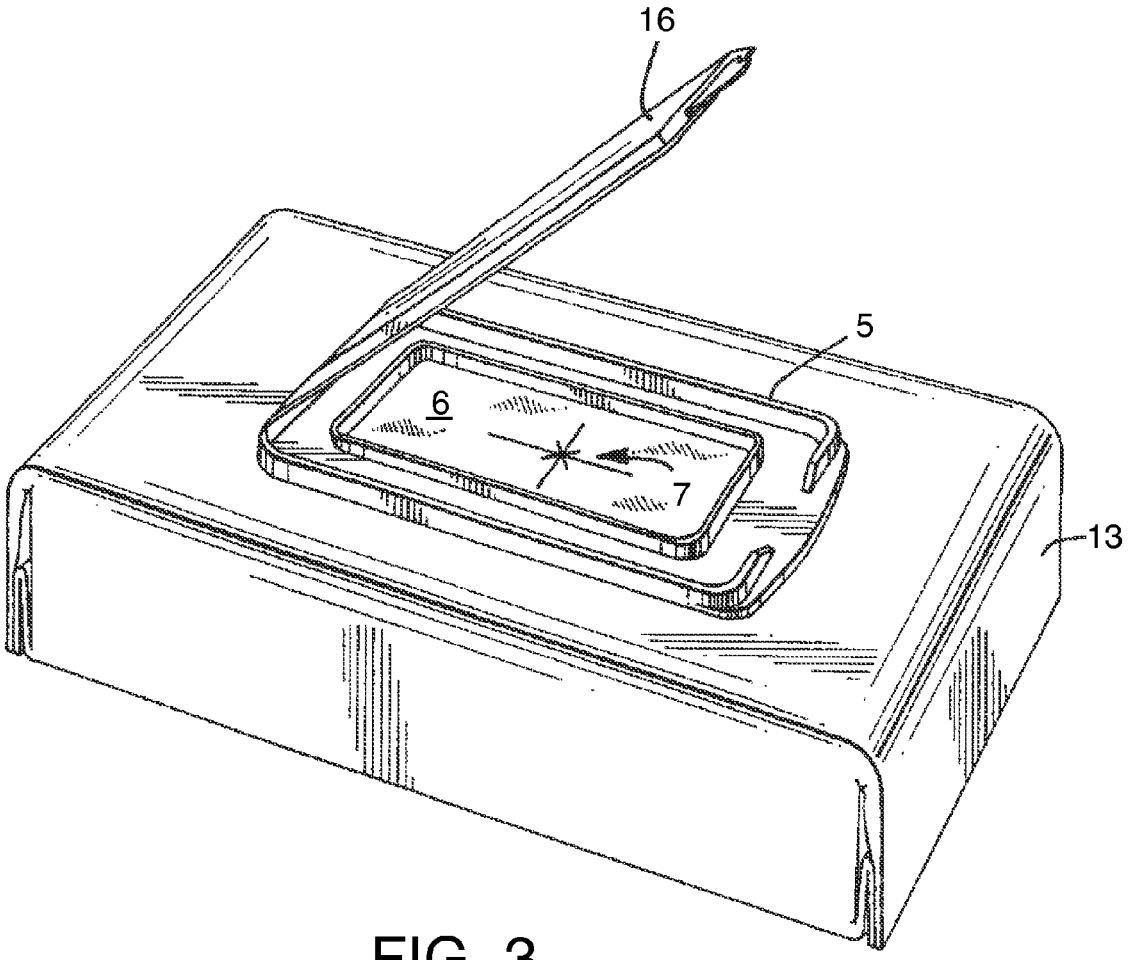
FIG. 3 is a perspective view of another embodiment of a wet wipe container embodying principles of this invention, wherein the dispensing means is attached to a flexible container package.

FIG. 3 is a perspective view of another container in accordance with this invention, in which the container is a flexible package, such as a plastic film-wrapped package, having a flip-top style dispensing opening. Shown is the flexible plastic film package 13 which contains a stack of wet wipes. A dispensing means is provided on the top of the package, which dispensing means comprises a rigid port 5 surrounding a flexible, rubber-like sheet having one or more slits 7 through which the wet wipes are removed from the package. The flip-top lid 16 can be closed over the rigid port to seal off the container when not being used. Any suitable closure design can be used to provide a proper seal.

Figure 4:
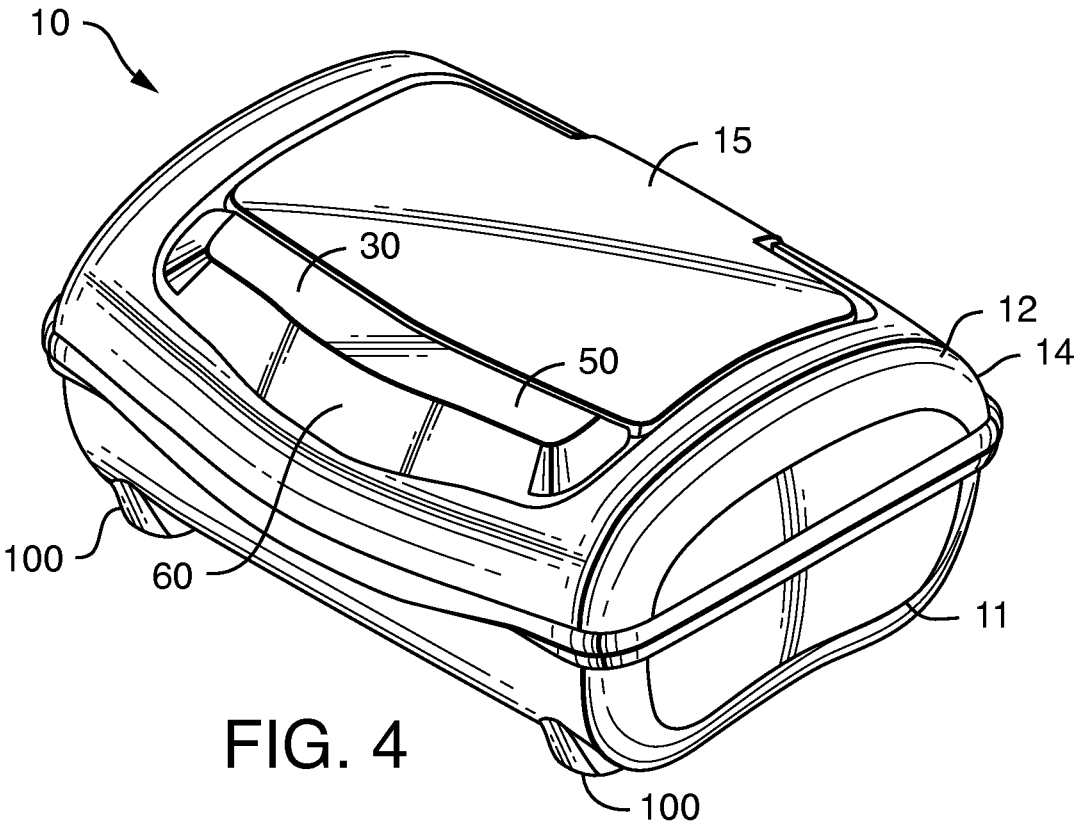
FIG. 4 is a perspective view of another embodiment of a wet wipe container embodying principles of this invention, with the lid closed and concealing the dispensing means.
Figure 5:
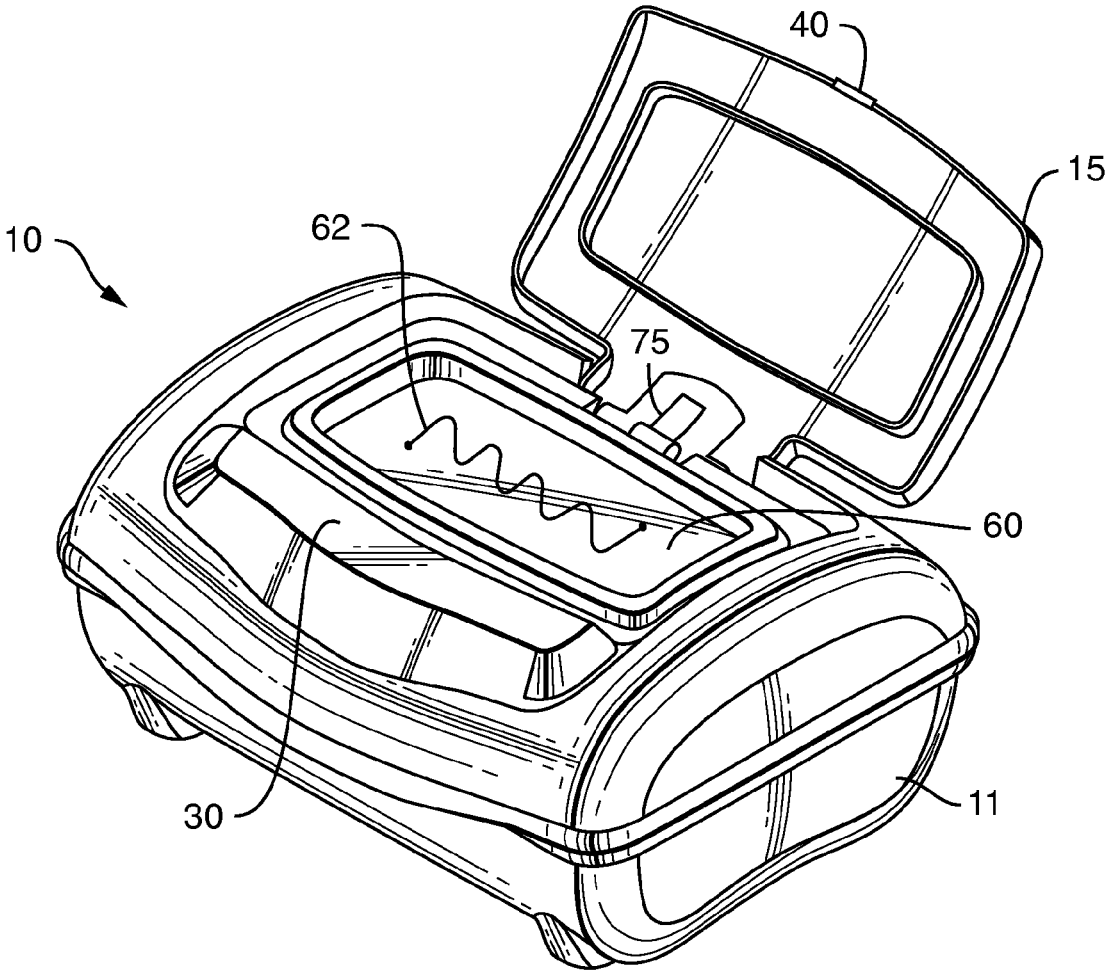
FIG. 5 is a perspective view of the embodiment of FIG. 4, shown with the lid open to reveal the dispensing means.

FIGS. 4 and 5 representatively illustrate another container incorporating principles of the present invention. A container 10 for storing wet wipe has a lid structure 12 and a container base 11. The lid structure and container base meet at a curved outer seam. However, the lid structure and container base have an internal rib that is straight to provide the necessary fit to prevent moisture loss. The container base 11 has front and back feet 100 to create a pedestal look on the counter and to allow the container 10 to sit on a curved surface (i.e. top of a toilet tank) with minimal or no rocking.

The lid top 15 is hingedly attached to a lid base 14 to allow a consumer access to contents of the container therethrough. A tension member 75 is positioned against the lid top and lid base at the hinge. The tension member 75 is formed by a band or strip of flexible rubber or plastic, such as silicone, and/or a metal spring. The end of the tension member 75 forces against the lid top 15 to urge apart the lid top 15 and lid base 14 when a consumer pushes the lid-activation button 30 to open the lid structure 12. The lid structure 12 may be formed as an integral part of the container 10 or may be positioned over a lid base 14. In an exemplary embodiment, the lid base 14 is connected to a container base 11 by a hinge to enable a second opening into the container 10. A consumer may then be able to, if desired, refill the container with additional wipes.

In an exemplary embodiment, the lid base 14 contains a pop-up style dispensing means comprising a flexible, rubber-like material or sheet 60 having a slit or hole 62 through which individual wet wipes are removed from the container 10. Suitable rubber-like materials include, for example, those described above. The dispensing means has a Penetration Index as described above. Surrounding the slit 62 in the dispensing partition sheet 60 is a dispensing partition sealing bump.

To enable access to the wipes stored within the container, the lid structure 12 includes a lid-activation button 30. The lid-activation button 30 comprises a substantially planar top surface 50 with a peripheral outer edge, the substantially planar top surface adapted to be contacted by a user. In some exemplary embodiments, the flexible rubber-like material 60 extends up from the lid base 14 and connects the remainder of the peripheral outer edge of the lid-activation button 30 to the lid base 14 to deliver a proper seal. Once the lid-activation button 30 is pressed and released by a consumer, the flexible rubber-like material 60 helps to compel the lid-activation button 30 back to its original position. After the lid-activation button 30 is pressed, the lid top 15 is released from the lid base allowing a user to access an opening into the container. The lid top 15 is secured in a closed position by a suitable lid latching mechanism 40.

Other features of the embodiment just described are disclosed in U.S. Patent Application Publication U.S. 2012/0048858, the entirety of which is incorporated by reference to the extent not inconsistent herewith.

Figure 6:
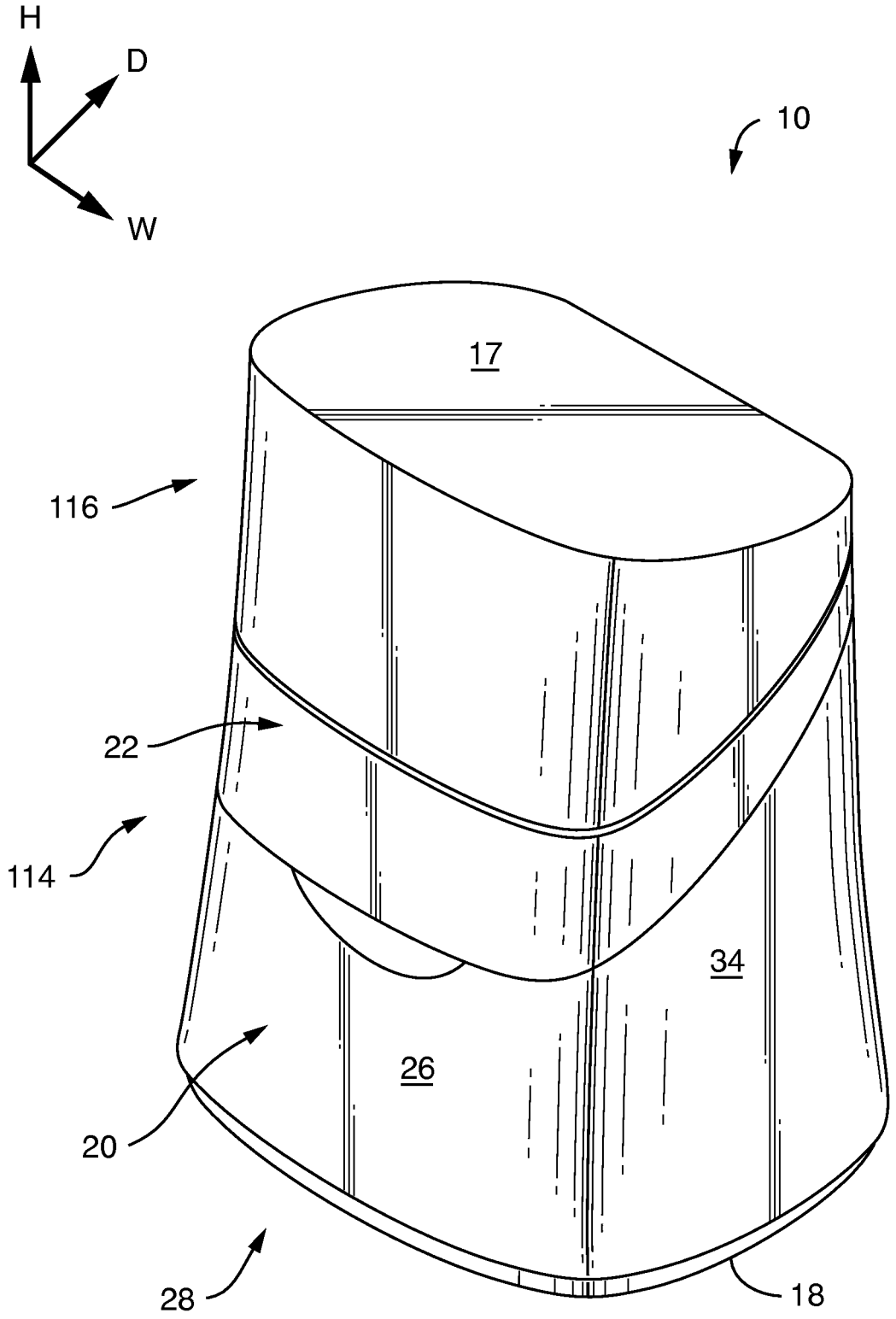
FIG. 6 is a front perspective view of another embodiment of a wet wipe container embodying principles of this invention, with the lid closed and concealing the dispensing means.
Figure 7:
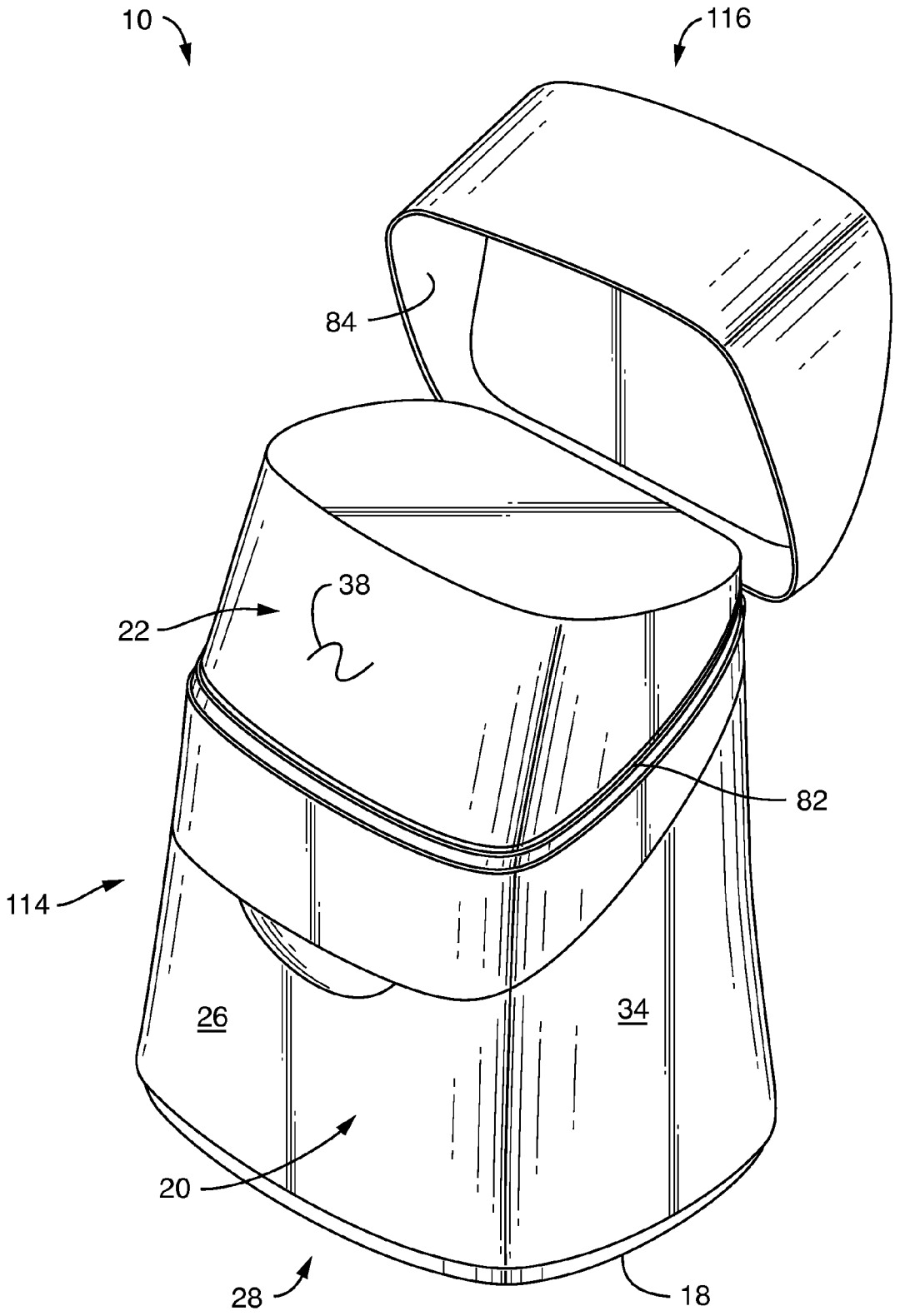
FIG. 7 is a front perspective view of the embodiment of FIG. 6, shown with the lid opened to reveal the dispensing means.
Figure 8:
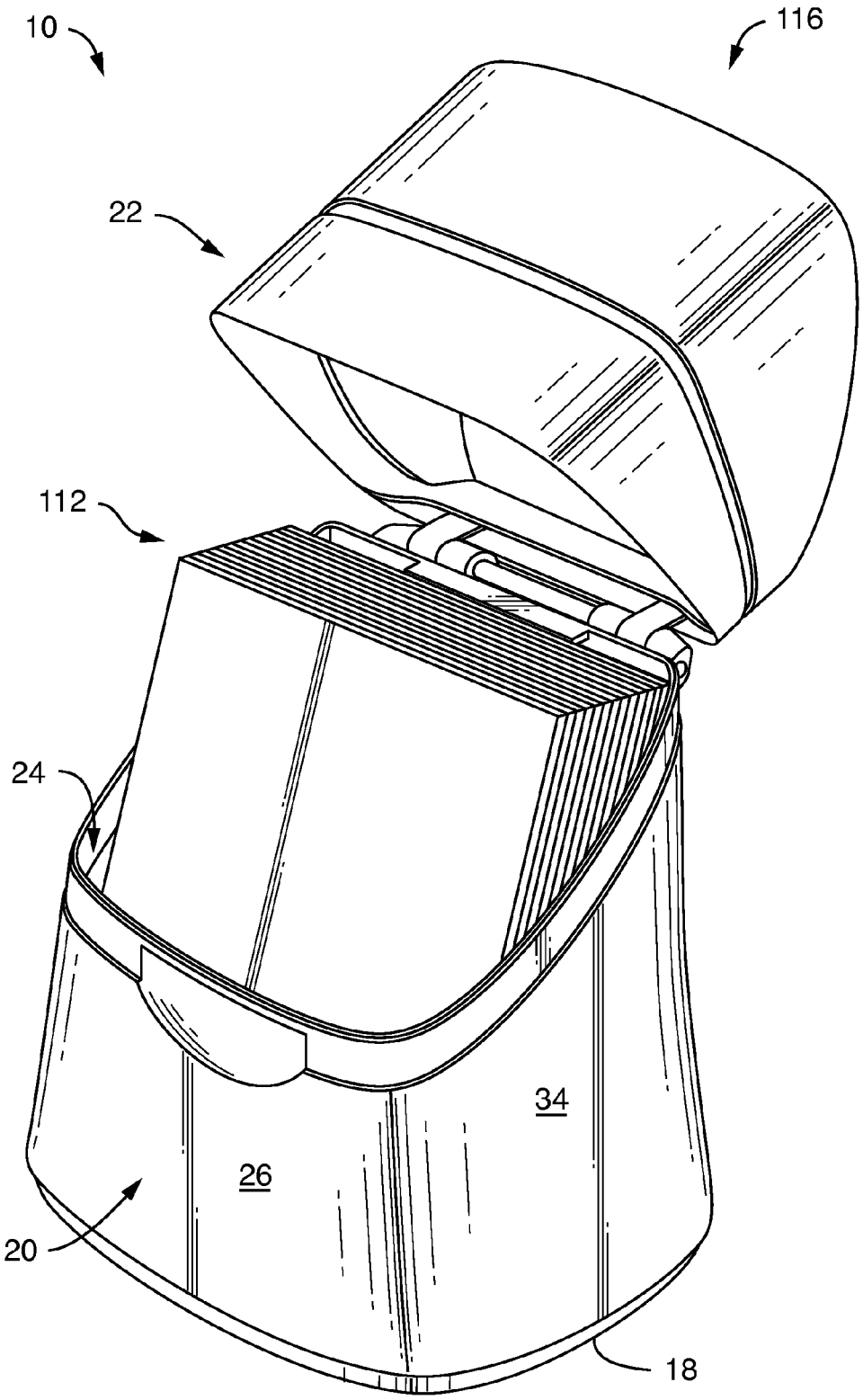
FIG. 8 is a front perspective view of the embodiment of FIG. 6, shown with the lid closed but with the top wall of the container base opened, showing a plurality of wipes in a stacked fashion in a vertical orientation.

FIGS. 6-8 representatively illustrate another container 10 for storing and dispensing wet wipes, such as a plurality of wipes 112. The container 10 includes a container body 114 and a lid 116. The container body 114 can include a bottom wall 18, a midsection 20, and a top wall 22. The container body 114 can define an interior cavity 24 for storing the plurality of wipes 112. As shown in FIG. 8, the plurality of wipes 112 can be stored in the interior cavity 24 in a stacked fashion and in a vertical orientation. It is contemplated, however, that the container body 114 can alternatively be configured to store the plurality of wipes 112 in a rolled fashion and/or in a horizontal orientation, as is known in the art.

The container 10 can have a generally rectangular shaped profile as shown in the embodiment in FIGS. 6-8. The midsection 20 of the container body 114 can include a front wall 26 located in a front portion 28 of the container 10, a rear wall located in a rear portion (not shown), and side walls 34 located in between the front wall 26 and rear wall 30. The front wall 26 is opposite from the rear wall and the side walls 34 are opposite from one another. Of course, the container 10 may be configured in other profiles, including but not limited to generally cylindrical profiles. In such a circumstance, the midsection 20 can be considered to be a unitary segment, rather than having a specific front wall 26, rear wall 30, and side walls 34, 36.

As illustrated in FIG. 7, the container body 114 can include a dispensing means including an aperture or slit 38 in the top wall 22 of the container body 114. A portion of the top wall 22, particularly near the dispensing aperture 38, can be manufactured from a thin, rubber-like, anti-slip material. The bottom wall 18 or a portion thereof can also be manufactured from a thin, rubber-like, anti-slip material. Examples of flexible rubber-like materials used in the container of the present disclosure are described above. The dispensing means has a Penetration Index as described above.

In the embodiment shown in FIG. 7, the dispensing aperture 38 is shown as a sinusoidal-type aperture in the top wall 22 of the container body 114 and in the front portion 28 of the container 10 near the front wall 26. However, the dispensing aperture 38 is not intended to be limited to such a configuration or location on the container 10. The dispensing aperture 38 can assist a consumer in the dispensing of an individual wipe from the plurality of wipes 112 by providing friction to the leading wipe from the plurality of wipes 112 as it is pulled through the dispensing aperture 38. This friction can help the consumer withdraw only a single wipe from the plurality of wipes 38, as is known in the art, whether the plurality of wipes 112 are in a stacked or rolled configuration and/or perforated in the various configurations known by one of ordinary skill in the art.

As shown in FIG. 8, the wipes can be stored in the interior cavity 24 in a stacked configuration and in a vertical orientation. As used herein, a vertical orientation means that the plurality of wipes 112 are stacked so that the end edges of each individual wipe that form the plurality of wipes 112 are oriented toward the bottom wall 18 more so than the midsection 20 of the container body 114. The end edges referred to herein could be a cut edge or a folded edge of each wipe of the plurality of wipes 112, depending on the configuration in which the plurality of wipes 112 are stored.

The lid 116 can include a top surface 17 that is angled toward the front portion 28 of the container 10. As shown in FIGS. 6-8, the lid 116 is configured to open and close by moving between an open position and a closed position. When the lid 116 is in an open position, as illustrated in FIG. 7, the lid 116 can provide access to the plurality of wipes 112. In FIG. 7, a consumer can access the wipes 112 via the dispensing aperture 38 in the top wall 22, which may hold the leading edge of the next successive wipe in the stack of wipes 112. Additionally, if both the lid 116 and the top wall 22 of the container body 114 are in an open position, as illustrated in FIG. 8, a consumer also has access to the plurality of wipes 112 and can replenish the container 10 with a plurality of wipes 112 as desired.

The force applied to urge the lid 116 to the closed position and remain in that position can help provide a gasketing effect to retain moisture in the wipes 112. As shown in FIG. 8, the top wall 22 can include a raised rib 82 around a substantial portion of the perimeter of the top wall 22, which in the exemplary embodiment is composed of TPE. Therefore, when the lid 116 is in the closed position, the raised rib 82 can sealingly engage an inner surface 84 of the lid 116.

Other features of the embodiment just described are disclosed in U.S. patent application Ser. No. 13/863,107, the entirety of which is incorporated by reference to the extent not inconsistent herewith.

The product, e.g., wipes or wet wipes, can be arranged in the dispensers described above in any manner which provides convenient and reliable one at a time dispensing and which assists the wipes in not becoming dirty and/or overly dry. For example, the wipes may be arranged in the dispenser or container as a plurality of individual sheets arranged in a stacked configuration to provide a stack of wipes which may or may not be individually folded. The wipes may be individual wipes which are folded in a c-fold, z-fold, quarter fold or other zigzag fold or interfolded or non-interfolded configurations as are known to those skilled in the art. The product may include a plurality of wipes stacked one on top of each other in a non-interfolded configuration, for "reach-in" dispensing. For such a non-interfolded wipe, each wipe is folded onto itself with no portion of another wipe being positioned between or underneath any portion of the folds of the adjacent wipe(s). These configurations for wipes, as well as those discussed herein, may be provided by means known to those skilled in the art.

Alternatively, the individual wipes can be interfolded or in other ways related such that the leading and trailing end edges of successive wipes in the stacked configuration overlap, for "pop-up" dispensing. In such a configuration, the leading end edge of the trailing wipe is loosened from the stack by the trailing end edge of the leading wipe as the leading wipe is removed by the user. The wipes can be interfolded to facilitate such dispensing by means known to those skilled in the art.

Yet alternatively, the wipes can be arranged in the dispenser as a continuous web of interconnected wipes which are folded in an accordion-like stacked configuration or a roll. The individual wipes can be connected together along lines of frangibility, such as lines of perforations, to ensure that the trailing wipe is in position for grasping by the user after the leading wipe is removed. For example, the wipes can be provided by a continuous web of material which has a series of lines of frangibility extending across the width of the web. The portion of the web of material between successive lines of frangibility provides each individual wipe. The lines of frangibility can be provided by means known to those skilled in the art such as perforations, indentations or cuts in the web of material. For example, the lines of frangibility or perforations can be provided in the web of material by passing the web of material between a die cutter roll and anvil roll. After the lines of frangibility have been incorporated into the web of material, the web can then be arranged in a stacked configuration for easy insertion into the dispenser during formation thereof.

The container can include any suitable number of individual wipes depending upon the desired packaging and end use. For example, the container can be configured to include a stack of wipes which can include at least about 5 wipes and desirably from about 8 to about 320 individual wipes, and more desirably from about 16 to about 80 wipes. The size and shape of the stack of wipes is dependent upon the size and shape of the container and vice versa.

Each wipe is desirably rectangular in shape and defines a pair of opposite side edges and a pair of opposite end edges which can be referred to as a leading end edge and a trailing end edge. The leading end edge of each wet wipe is typically positioned in the dispenser under the dispensing orifice to be grasped by a user to facilitate a removal of the wipe from the container.

Materials suitable for the wipes of the present disclosure are well known to those skilled in the art. For wet wipes, these can be made from any material suitable for use as a moist wipe, including meltblown, coform, air-laid, bonded-carded web materials, hydroentangled materials, high wet-strength tissue and the like and can comprise synthetic or natural fibers, or combinations thereof. The wipes of the different aspects of the present disclosure can contain a liquid which can be any solution which can be absorbed into the wipes, thus making them "wet wipes." The liquid contained within the wet wipes can include any suitable components which provide the desired wiping properties. For example, the components can include water, emollients, surfactants, preservatives, chelating agents, pH buffers, fragrances, or combinations thereof. The liquid can also contain lotions, ointments and/or medicaments. The amount of liquid contained within each wet wipe can vary depending upon the type of material being used to provide the wet wipe, the type of liquid being used, the type of container being used to store the stack of wet wipes, and the desired end use of the wet wipe. Generally, each wet wipe can contain from about 15 to about 600 weight percent and desirably from about 200 to about 400 weight percent liquid based on the dry weight of the wipe for improved wiping.

In particular embodiments, it can be desirable to include in the liquid solution an anti-adhesion component, which can reduce sheet-to-sheet adhesion, improve dispensing, and improve wipe flexibility and softness. In particular embodiments, the anti-adhesion component includes an organopolysiloxane. Examples of suitable anti-adhesion components for wet wipes are taught in U.S. Pat. No. 8,030,226 issued Oct. 4, 2011 to Bradley et al., the entirety of which is hereby incorporated by reference to the extent not inconsistent herewith. It has been discovered that when certain anti-adhesion components, such as those taught in the '226 patent, dispensing can be optimized by using dispensers with dispensing means having the features, including but not limited to the Penetration Index, disclosed herein.

EXAMPLES

Prototypes wet wipe dispensers were created. Wipes were stored and dispensed in each, and the Penetration Index of each dispenser was tested.

The Penetration Index of the dispenser illustrated in FIGS. 4-5 was tested. Ten separate specimens were tested. The average Penetration Index of the ten specimens was 1213 grams, with a standard deviation of 177 g.

The Penetration Index of the dispenser illustrated in FIGS. 6-8 was tested. Three separate specimens were tested. The average Penetration Index of the three specimens was 3948 grams, with a standard deviation of 172 g.

While the dispensing means useful for purposes of this invention has been specifically illustrated in three different styles of container, those skilled in the art will appreciate that many different container designs are possible, including canister style containers, without departing from the scope of the invention.

It will be appreciated that the foregoing description, given for purposes of illustration, is not to be construed as limiting the scope of the invention, which is defined by the following claims and all equivalents thereto.

We claim:

1. A wet wipe dispensing container containing interfolded or integrally interconnected wet wipes and having a pop-up style dispensing means positioned beneath a retractable lid, said dispensing means comprising a rigid port surrounding a flexible, rubber-like material, said material having one or more slits through which individual wet wipes are removed from the container when the lid is open, wherein the flexibility of the sheet and the length of the slit(s) in combination are sufficient to enable a user to insert at least one finger through the slit to thread a wipe through the slit and wherein the dispensing means has a Penetration Index of greater than 1000 grams.

2. The container of claim 1 wherein the wet wipes are contained within a flexible package.

3. The container of claim 1 wherein the wet wipes are contained within a rigid tub.

4. The container of claim 1 wherein the flexible, rubber-like sheet or material has a Shore A hardness of about 100 or less.

5. The container of claim 1 wherein the flexible, rubber-like sheet or material has a Gurley stiffness of about 10,000 mgf or less.

6. The container of claim 1 wherein the flexible, rubber-like sheet or material has a thickness of about 0.1 millimeter or greater.

7. The container of claim 1 wherein the flexible, rubber-like sheet or material has an elasticity of about 10 Mpa or less.

8. The container of claim 1 wherein at least one slit has a length of about 1 inch or greater.

9. The container of claim 1 wherein said flexible, rubber-like material includes only one slit, said one slit having a Z-shape or S-shape.

10. The container of claim 1 wherein the Penetration Index is greater than 2000 grams.

11. The container of claim 1 wherein the Penetration Index is greater than 3000 grams.

12. The container of claim 1 wherein the wet wipes comprise an anti-adhesion component adapted to reduce sheet-to-sheet adhesion, the anti-adhesion component comprising an organopolysiloxane.

13. A wet wipe dispensing container containing interfolded or integrally interconnected wet wipes and having a pop-up style dispensing means positioned beneath a retractable lid, said dispensing means comprising a rigid port surrounding a flexible, rubber-like material, said material having one or more slits through which individual wet wipes are removed from the container when the lid is open, wherein the flexibility of the sheet and the length of the slit(s) in combination are sufficient to enable a user to insert at least one finger through the slit to thread a wipe through the slit and wherein the dispensing means has a Penetration Index of greater than 1000 grams, wherein the flexible, rubber-like material has a Shore A hardness of about 100 or less, wherein the flexible, rubber-like material has a Gurley stiffness of about 10,000 mgf or less, wherein the flexible, rubber-like material has a thickness of about 0.1 millimeter or greater, wherein the flexible, rubber-like material has an elasticity of about 10 Mpa or less, wherein said flexible, rubber-like material includes only one slit, said one slit having a Z-shape or S-shape, the wet wipes further comprising an anti-adhesion component adapted to reduce sheet-to-sheet adhesion, the anti-adhesion component comprising an organopolysiloxane.

14. The container of claim 13 wherein the Penetration Index is greater than 2000 grams.

15. The container of claim 13 wherein the Penetration Index is greater than 3000 grams.

* * * * *